US009194205B2

(12) United States Patent
Brandsdal et al.

(10) Patent No.: US 9,194,205 B2
(45) Date of Patent: Nov. 24, 2015

(54) DEVICE FOR A PLUG CONSTRUCTION FOR CONDUCTING WELL TESTS

(75) Inventors: Viggo Brandsdal, Ytre Arna (NO); Morten Lerbrekk, Bryne (NO)

(73) Assignee: TCO AS, Bergen (NO)

( * ) Notice: Subject to any disclaimer, the term of this patent is extended or adjusted under 35 U.S.C. 154(b) by 238 days.

(21) Appl. No.: 13/635,054

(22) PCT Filed: Mar. 30, 2011

(86) PCT No.: PCT/NO2011/000110

§ 371 (c)(1),
(2), (4) Date: Sep. 14, 2012

(87) PCT Pub. No.: WO2011/122957

PCT Pub. Date: Oct. 6, 2011

(65) Prior Publication Data

US 2013/0014933 A1 Jan. 17, 2013

(30) Foreign Application Priority Data

Mar. 30, 2010 (NO) ..... 20100468

(51) Int. Cl.
*E21B 33/12* (2006.01)
*E21B 34/06* (2006.01)
*E21B 47/10* (2012.01)

(52) U.S. Cl.
CPC ..... *E21B 33/12* (2013.01); *E21B 34/06* (2013.01); *E21B 47/10* (2013.01)

(58) Field of Classification Search
CPC ..... E21B 33/10; E21B 33/12; E21B 34/06
USPC ..... 166/316, 319, 332.1, 373, 374, 142, 166/145, 151, 183, 184, 188
See application file for complete search history.

(56) References Cited

U.S. PATENT DOCUMENTS

| | | | | |
|---|---|---|---|---|
| 7,980,313 | B2 * | 7/2011 | Barbee, Jr. | 166/325 |
| 2003/0168219 | A1 * | 9/2003 | Sloan | 166/373 |
| 2003/0178205 | A1 | 9/2003 | Henderson | |
| 2006/0219406 | A1 * | 10/2006 | Boney et al. | 166/285 |
| 2007/0199693 | A1 * | 8/2007 | Kunz | 166/179 |
| 2008/0073075 | A1 | 3/2008 | Buyers | |

FOREIGN PATENT DOCUMENTS

GB 2 130 274 A 5/1984

* cited by examiner

*Primary Examiner* — Brad Harcourt
(74) *Attorney, Agent, or Firm* — Francis C. Hand; Byrne Carella, et al.

(57) ABSTRACT

A device is described for a system for conducting tests of a well, pipe or the like, where a plug of a removable material is inserted in a pipe through a well to carry out said tests. The device is characterized in that the wall parts of the pipe comprise channel borings (3,4,8) that set up fluid connections between the well space (70) and the well space (72) above and below, respectively, the plug, and that it comprises a closing body that can close the fluid connection permanently. The channel boring is preferably defined by an axial hollow space/chamber (4) in which a piston is arranged, said piston can be readjusted by an axial movement from a first position where there is fluid connection through the channel and a second position where the connection is permanently closed and can not be reopened.

8 Claims, 5 Drawing Sheets

DEVICE FOR A PLUG CONSTRUCTION FOR CONDUCTING WELL TESTS

The present invention relates to a device for a plug construction as can be seen in the introduction of the subsequent claim 1.

To use plugs for testing oil wells with production pipes, for example, is well known, i.e. to be able to test the pipe in advance that it is sufficiently leakproof. One such test can be that when the plug is placed in the pipe and closes for through-flow of the fluid, the fluid pressure increases from the surface and is held at a higher level and one then registers a possible pressure drop which is a sign of how leakproof the pipe is.

Normally such plugs are either of the type that is connected to a wire, a so-called wireline, plugs that are removed in that they dissolve, so-called disappearing plugs, or plugs that are removed by subjecting them to pulses of fluid pressure, called fluid cycle open valves integrated in the pipe.

Today's known systems with cycle open valves give the operators the possibility to communicate with the well by opening the valve so that fluid replacement is possible by opening of a valve. Refilling of fluid as the completion is conducted down in the well is not necessary either as the valve is driven to an open position to then be closed when the completion is in place in the well. The disadvantage with these valve types is that they are very difficult to open if they fail and cycle open. This leads to time consuming and costly operations for the operators.

The known wireline set plugs give the same advantages as the cycle-open valves with regard to communication with the well, as these plugs are not set before the completion shall be pressure tested and one thus has full flexibility during the driving of the completion and can replace the fluid in the well to set the plug. Wireline plugs are also set at the top of the completion which gives a so-called tubing hanger test plug. This is to test the top of the completion to a working pressure as the lower parts of the completion will not withstand this pressure plus the hydrostatic pressure in the well. Today there are no systems for testing of this in existence without costly "workover riser" operations being carried out to bring out these wireline set plugs.

Wireline set plugs also lead to costly operations such as driving of a "workover riser" to bring these out of the well which naturally enough must be done as they plug the completion pipe which it shall be produced through.

Known disappearing plugs solve some of these problems at the same time as they introduce a new one. Disappearing plugs have as common characteristic that they are manufactured from a material that can be dissolved or can contain an explosive material which is detonated by imposing pressure cycles so that the plug material is crushed. It is a great advantage that the plugs are manufactured from such materials as they are relatively easy to remove if they should fail and open later than intended.

The disadvantage with these plugs is that they are all so-called tubing conveyed, i.e. driven as a part of the completion string. This implies that for every new pipe section which is screwed securely to the completion and is fed down into the well, liquid must be filled in this pipe manually. This is time consuming and costly for the operators. With today's disappearing plug systems one does not have the possibility to communicate with the well via/through the plug either, as these disappearing plugs plug the pipe 100% and do not allow communication with the well or the underside of the plug. It is also very difficult to use the known disappearing plugs to test the tubing hanger as a plug for this purpose must have communication past the plug body so that the systems below the plug before the upper tubing hanger plug is removed can be tested.

The best known disappearing plugs are ceramic plugs, glass plugs and plugs made from hard pressed salt encapsulated by rubber and which is dissolved by pumping in water.

With regard to prior art, reference is made to the U.S. Pat. No. 6,026,903 and US 2008/0073075.

The first of these, U.S. Pat. No. 6,026,903 describes a plug of a removable material which is used in tests of a well comprising a circulation channel that lies between the pipe wall and the plug. The plug is pushed so that it closes the circulation channel, and the fluid connection between the well space above and below the plug will then be permanently closed.

US 2008/0073075 also describes a plug of a removable material and here there is an outer pipe lying on the outside of the inner pipe and an annular channel is set up which forms a fluid connection between the well space above and below the plug. A closing body can close the fluid connection in the channel.

However, it is not known from this publication that channel borings for the purposes that are given above are formed through the pipe wall as is the case for the construction according to the present invention.

The device according to the invention is characterised in that the wall parts of the pipe comprise channel borings that establish a fluid connection between the well space above and below, respectively, the plug, and that this comprises a closing body that can close the fluid connection permanently.

The device can comprise one or more internal closable channels which can permit communication with the well below the plug body.

The channel borings preferably comprise an axial hollow space/chamber in which a piston is arranged, said piston can be readjusted by an axial movement from a first position where it permits fluid connection through the channel and a second position where the connection is permanently closed and can not be reopened.

In a preferred embodiment the piston has an upper enlarged piston part and a lower enlarged piston part which both seal against the hollow space-inner wall with gaskets, and also a between-lying piston part in the chamber.

According to a preferred embodiment a further channel forms a connection between the pipe volume and to a chamber on the underside of the enlarged upper top part of the piston, a valve is placed in said channel that can be made to let pipe fluid with pressure in to the volume below the enlarged piston part, and when the signal is given the valve opens so that the pressure in the chamber increases and the closing body/piston starts to move up in the channel so that the fluid connection through the channels is closed.

According to yet another preferred embodiment the channels are formed by a boring horizontally directed, or at an angle, through the pipe wall from an area above the plug and into the axial chamber integrated in the pipe wall, and a corresponding boring from the bottom of the chamber, through the pipe and out into the space below the plug.

According to yet another preferred embodiment the boring for the channel is a ring-formed channel that runs around the whole of the circumference inside the pipe and with a number of channels through the pipe wall out into the pipe volume above and below, respectively, the plug.

According to yet another preferred embodiment concerns when the underside of the closing body has passed the channel it is closed for fluid communication through the channels so that the plug body together with the closing body constitute a complete closure.

According to yet another preferred embodiment the closing of the fluid connection is activated by sending in pressure pulses by electronically controlled tripping devices, or with the help of a separated control line that leads down to the opening valve or by the help of time-controlled mechanisms or other electronic triggers for closing.

According to yet another preferred embodiment the plug is a disappearing plug, i.e. a plug body that is made from, for example, glass, ceramic materials or hard-pressed salt or other fluid-soluble materials.

According to yet another preferred embodiment the closing bodies are placed in the outer wall of the plug so that they initially permit communication past the plug body through the channels arranged in the outer wall.

According to yet another preferred embodiment one or more closing bodies are set up so that they are locked when they are activated for closing so that pressure from the well side (the underside of the plug body) can not lead to the passage past the plug body being pushed back and reopening the channel.

Several types of valves are known that can be opened and be closed with the help of pressure signals. However, such systems with internal channels in the pipe wall are not known, and which can form a fluid connection between the areas above and below the plug in the pipe. The known slide valves all have channels for communication directly out through the outer wall of the production pipe as they are designed to open and close for production between different zones of the well. It will not be possible to use a such valve, for example, at the top of a disappearing plug so that it is possible to use it as a tubing hanger test plug, one can not have communication out through the tubing pipe for the production to the annulus (the annular space between pipe and well wall) as this will lead to full well pressure out to the area where an external casing pipe is not designed for such pressures. To be able to use a disappearing plug as a tubing hanger test plug one must have internal communication past the plug body that can be opened and closed. Disappearing plugs have been known since the 1930's, also known is the way one must drive tubing hanger-test plugs and that this is a costly operation. However, no-one has managed to make the coupling between the technology of an internal, small slide valve in a communication channel past the plug body and down to the well so that one saved time and money.

The channel can preferably comprise internal through-going circulation gates past the plug body.

Particularly preferred is to use a closing system that closes the channel(s) permanently and that can not be reopened.

This will lead to that one can use disappearing plugs on most areas through the pipe and permit communication with the underside of the plug body through these channels.

The channels must preferably be able to be closed either with the help of pressure pulses or with the help of a control line down to an activation body. One can also imagine these channels being closed with the help of different time-controlled mechanisms or other electronic triggers for the closing.

The system will preferably comprise a disappearing plug, i.e. a plug body that is made from, for example, glass, ceramic materials or hard-pressed salt or other liquid-soluble materials, with such internal channels past the plug body.

The plug preferably comprises one or more closing bodies in the outer wall of the plug that can be moved axially in the longitudinal direction of the plug.

One or more of the closing bodies is preferably arranged in the outer wall of the plug so that they initially allow communication past the plug body through channels arranged in the outer wall.

A release mechanism is preferably arranged in connection with the one or more closing bodies placed in the outer wall, so that the release mechanism, when activated, preferably by an axial movement in the closing body, will close the channels that permit communication past the plug body.

These one or more closing bodies must preferably be installed in such a way that they are locked when they are activated for closing so that pressure from the well side (the underside of the plug body) can not lead to the passage past the plug body being pushed back and reopening the channel.

The preferred embodiments appear in the dependent claims.

The great advantage of such a plug that has these circulation channels past the plug is that one can then use disappearing plugs in many more use areas or application areas than previously. With a such plug one can, for example, place a disappearing plug in the top of the completion string as a tubing hanger test plug something which has not been possible until today.

By completion is meant to make ready, for example, a production pipe with the necessary fittings and instrumentation to start the HC production, for example, to perforate the production pipe through a formation to start the inflow of oil and gas to the pipe.

Today, wireline plugs are used and are driven exclusively as tubing hanger test plugs. This is very costly as one, for example, must drive 3000 meters with a so-called workover riser to be able to pull these plugs when the well shall start to produce. To be able to drive a disappearing plug one must have fluid communication past the plug for, firstly to be able to carry out tests on equipment on the underside of the plug to close these communication channels and conduct tests to higher pressures on the tubing hanger only.

It is very important that a such communication gate is able to withstand pressure from the underside without any risk for it opening again, i.e. that the pressure from the well side must be actively maintained and promote closing of these communication channels as the plug and these channels past the plug body contribute a part of the barrier against the well.

Without such communication channels past the plug body one can not drive disappearing plugs in the well, for example, as a tubing hanger test plug.

Valve type the plugs can be considered operated with open valve in the same as a tubing hanger test plug to close them when one is finished with tests down in the hole. These valve types have, because of space demanding ball valve/leaf valve design (leaf valve) too low tensile strength in the body so that one can suspend all the completion tubing under them. Something which means that one has limited space in the well head and thereby gets limited wall thickness. There are also very large costs with such intervention jobs with such valves if they should turn out not to open at the required point in time. Traditionally, plugs of the wireline type have always been used as tubing hanger test plugs because of the high risk of driving valves with metallic sealing surfaces that can be opened and closed. Disappearing plugs required a much smaller wall thickness to be able to function and it is thereby possible to make disappearing plugs with internal circulation communication channels, at the same time as a satisfactory strength can be maintained in the plug body. Disappearing plugs are also known to be able to be opened easily with intervention jobs and have therefore several advantages in relation to traditional steel valves and wireline plugs.

With the use of a disappearing plug one can also save several weeks of costly rig time as one does not have any need for the rig after the well is completed, for example, on a subsea well, one can continue to drill the well, complete the well and then to leave the well with plugs installed, whereupon one can come back with a X-mas tree and install this from a vessel and then cycle open the tubing hanger plug in the well through the valve tree (X-mas tree). A such operation is not possible with today's systems of pullable plugs as they require equipment to control the pressure down in the subsea well to be able to pull these plugs with the wireline method.

The invention shall now be explained in more detail with reference to the enclosed figures, in which.

PREFERRED EMBODIMENT OF THE INVENTION

The present invention is characterised in that a plug body placed in a pipe section has a communication channel past the plug body, where the communication channel comprises a body that can close the communication channel when an activation signal is given, so that the plug body forms a 100% closure of the channel and thereby together with the plug body closes for all fluid flow through the pipe. A such signal can be given in the form of a hydraulic impulse, an electric signal, a radio signal or other known signal types. Many methods to conduct such closing operations are known, and these are not dealt with in this application.

Figure 1:
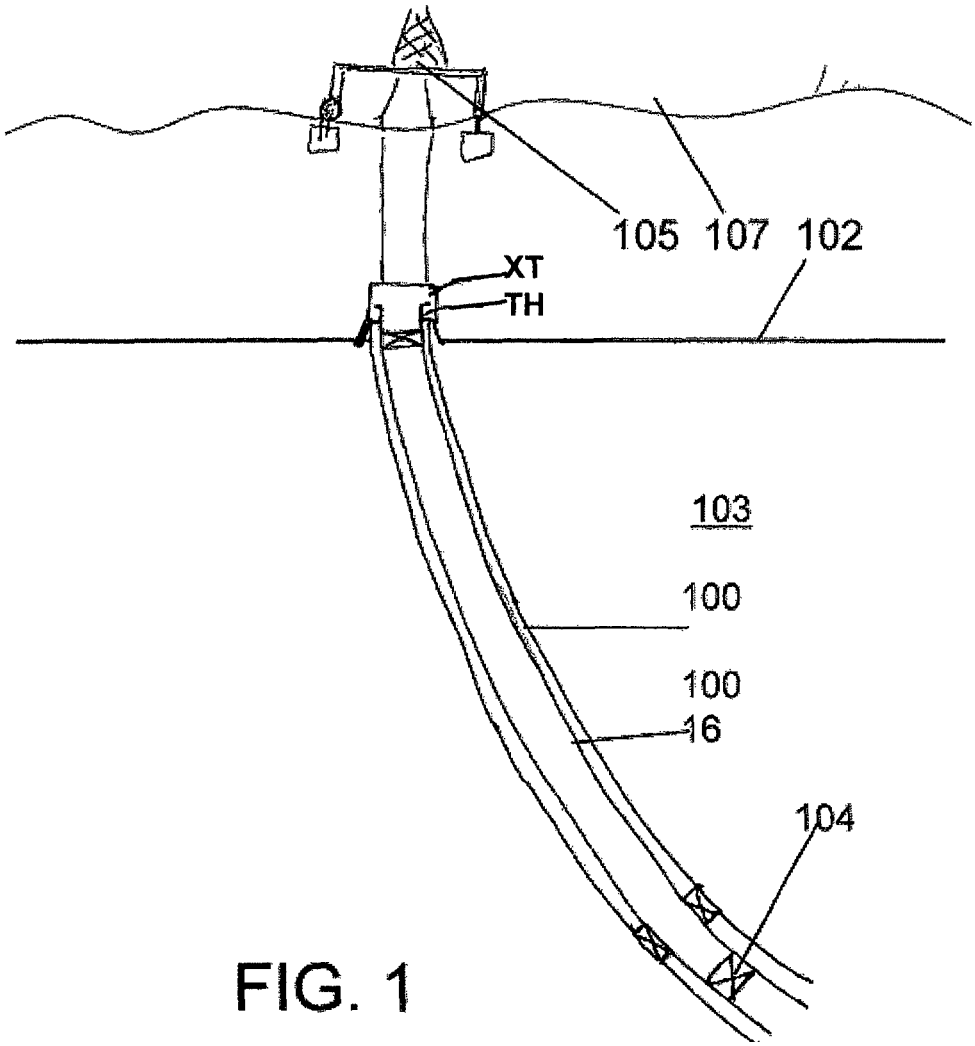
FIG. 1 shows an application area offshore for the invention with a bored out well from the ocean bed and down into the oil/gas containing formation.

With reference to FIG. 1, a well 100 is shown which is drilled from the ocean bed 102 and down through a formation 103. Inserted in the well 100 is a pipe 16, a tubing hanger pipe TH, with an upper plug 1 and a plug 104 some distance down in the well. Furthermore, a so-called X-mas tree (XT in FIG. 1) is placed on the ocean bed 102. The pipe 106 continues further up to the surface of the sea 107 where it is operated via a floating installation 105.

Figure 2:
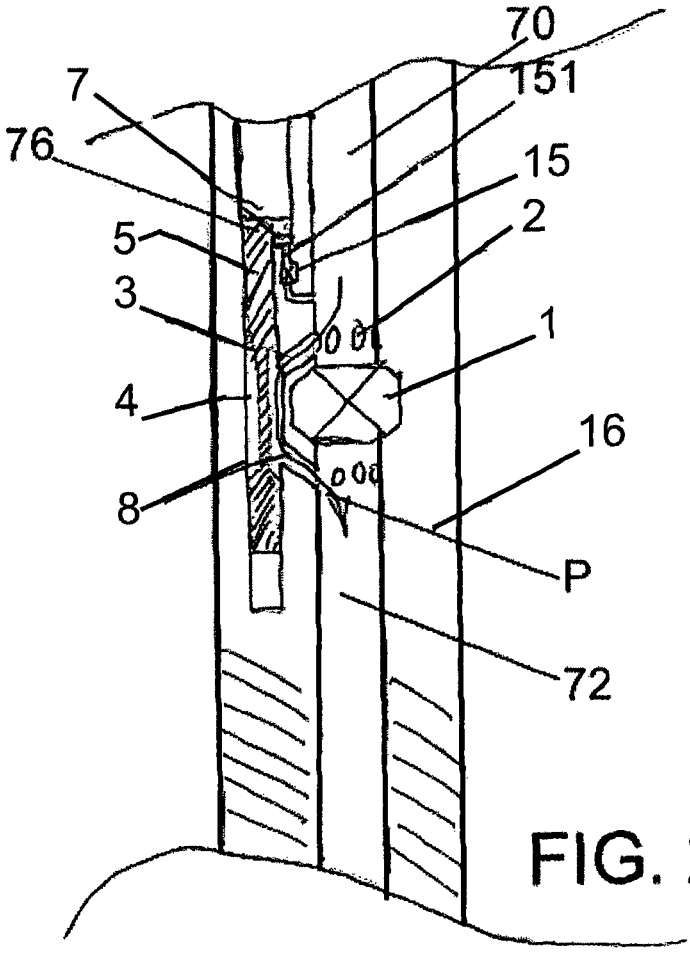
FIG. 2 shows the present invention in normal position where the closing valve stands open and is not activated, and there is free fluid passage.

The present invention is characterised in that a plug body 1 is placed in the pipe 16 and a plug body 1 is a disappearing plug, i.e. that it is made from a crushable material such as glass or a ceramic material, or a fluid dissolvable material. The plug 1, for example, with a six sided shape with tilted surfaces, is inserted in a dedicated plug seat in the pipe. The pipe channel (the volume) above the plug 1 is referred to by the reference number 70, whilst (the volume) below the plug 1 is arranged below plug 1 is referred to by 72. The plug body 1 is placed in the pipe 16. In the wall section 16 of the pipe which the plug body 1 is fitted in, a bypass channel 3,4,8 is formed, which, when it is open, establishes fluid connection between the pipe volume 70 above the plug 1 and the pipe volume 72 below the plug 1. Fluid flow through the channel is indicated with the arrow P in FIG. 2. In more detail, the channel constitutes a boring 3 (for example, at an angle) through the pipe 16 from the topside of the plug 1 and into a chamber 4 in the pipe wall (for example, uppermost in the chamber), and a corresponding boring 8 from the chamber (for example, from the bottom of the chamber) through the pipe 16 and out into the pipe volume 72 below the plug 1.

The pipe 16 can comprise one or more such communication channels 3,4,8 from the one side of the plug body 1 to the other side of the plug body 1. By reference number 2 it is indicated that the channel can comprise several such channels. The boring out for the channel 4 can be a ring-formed channel that runs around the whole of the circumference of the inside of the pipe, and with a number of channels through the pipe wall 16 out to the pipe volume 70 and 72 above and below, respectively, the plug.

A closing body 5 in the form of an extended casing or a piston is placed in the communication channel 4. The piston has an upper enlarged piston part 51 and a lower enlarged piston part 53 which both seal against the hollow space-inner wall with gaskets 12,13,14.

In the example shown the closing body 5 is adjusted to the communication channel 4 and has the gaskets 12,13,14 that are adjusted to the channel 4. The closing body/piston 5 has a larger area at its upper part/the top 76. A further channel 151 forms a connection to the pipe volume 70 and to a chamber 7 on the underside of the enlarged top part 76 of the piston. A further valve 15 is arranged in the channel 151, which can be brought to release pressure from the pipe fluid in 70 in to the volume 7 on the underside of the enlarged piston part. When a signal is given, the valve 15 opens so that the pressure in the chamber 7 increases and the closing body/piston 5 starts and moves up in the channel 4.

Figure 3:
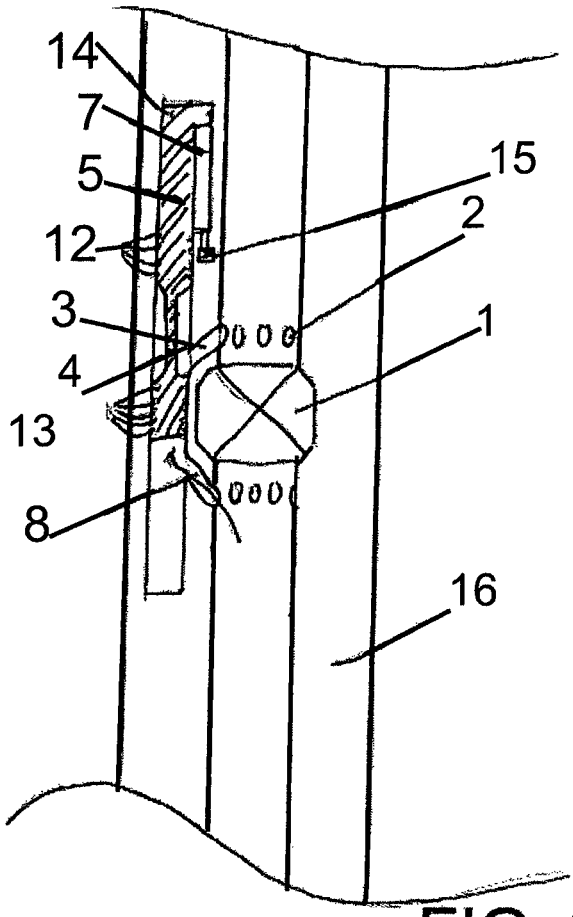
FIG. 3 shows the construction according to FIG. 2 where the closing valve is activated to close the fluid channel.

When the underside of the closing body 5 has passed the channel 8 it is closed for fluid communication through the channels 2,3,4,8 so that the plug body 1, together with the closing body 5, provide a full closure of the pipe 16. The closing body 5 moves up so that at a pressure build-up from the underside (via the channel 8 against the underside 51 of the piston), the channel system 3,4,8 will be permanently closed. This solution is shown in the FIGS. 2 and 3.

According to the invention it is preferred (most practical) that the closing body 5 gets its force from the hydrostatic pressure of the well, this can also, for example, be replaced by solutions where compressed gas is used. According to the invention it is also preferred that the closing body 5 is placed horizontally in the pipe 16, but it can also be conceived that one has several axial borings to a closing piston in each boring, and where the fluid pressure can influence the pistons 5 arranged around the circumference of the pipe around the plug element 1.

These imagined pistons can be moved inwards or outwards from the centre line of the plug body 1 whenever required.

Figure 4:
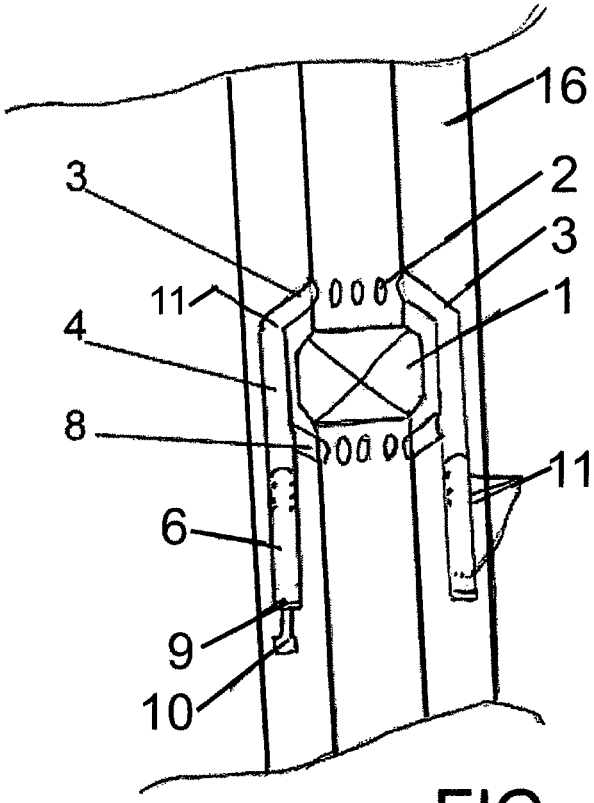
FIG. 4 shows an alternative solution of the present invention in section in untriggered position and there is fluid passage.
Figure 5:
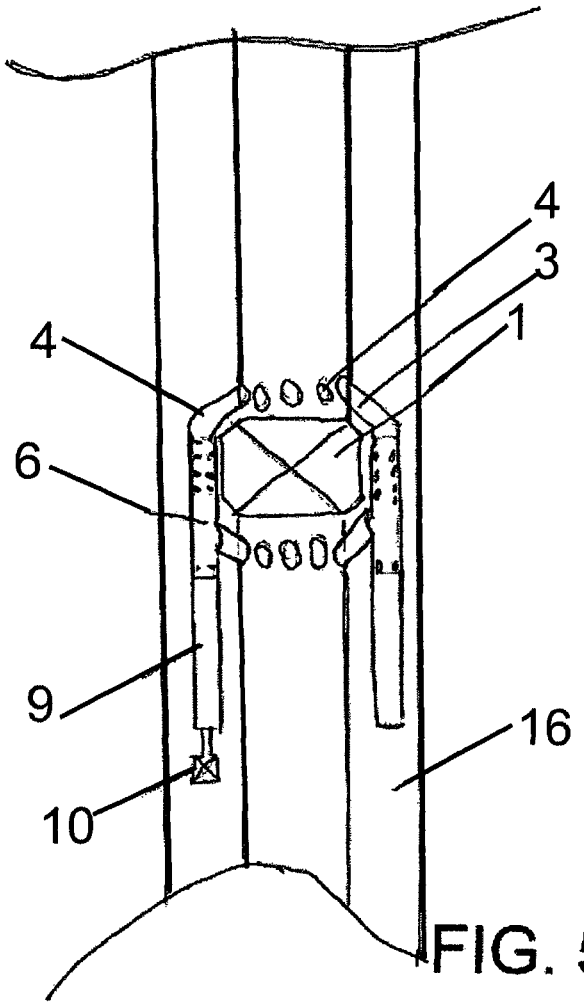
FIG. 5 shows the construction in FIG. 4 where the closing valve is activated to close the fluid channel.

In a preferred embodiment there can also be arranged a surrounding piston 6 that also moves axially with regard to the plug element 1 in channel 4. In this version the piston 6 is placed below the circulation channel 3,4,8 so that when a signal is given from a control valve 15 and which stands on the underside of the channel 4 below the piston, pipe pressure is released into the underside. The piston is pushed upwards and blocks the channel 4 between the angled borings 3 and 8 to the underside and the top side, respectively, of the plug. This solution is shown in the FIGS. 4 and 5.

With the present invention a large technical advance is provided in this area that includes test plugs in a disintegrateable/crushable material. One also has the possibility to use plugs in a disintegrateable/crushable material as tubing hanger test plugs as one now has set up communication channels past the plug body and which can communicate across the plug body without having communication to the annulus side of the tubing. This leads to considerable cost savings for the operators as they do not have to drive a workover riser, something which can typically save the operators up to one week in rig time.

The invention claimed is:

1. In combination, a pipe;

a plug of a removable material seated in said pipe to seal an upper volume of said pipe from a lower volume of said pipe;

at least one bypass channel in said pipe communicating said upper volume of said pipe with said lower volume of said pipe, said bypass channel including an axially disposed chamber; and a closing body disposed in said axially disposed chamber for axial movement between a first position maintaining said upper volume of said pipe and said lower volume of said pipe in fluid communication with each other and a second position closing communication between said upper volume of said pipe and said lower volume of said pipe, and wherein said closing body is a piston having an upper enlarged piston part in sealed relation to said bypass channel, a lower enlarged piston part in sealed relation to said bypass channel, and an intermediate piston part between said upper enlarged piston part and said lower enlarged piston part spaced circumferentially from said bypass channel.

2. The combination as set forth in claim 1 further comprising a second channel communicating said upper volume of said pipe to an underside of said upper enlarged piston part; and a valve in said second channel for selectively delivering pressurized pipe fluid from said upper volume to said underside of said upper enlarged piston part for movement of said closing body to said second position thereof.

3. The combination as set forth in claim 2 further comprising at least one of a means for generating pressure pulses, an electronically controlled trigger device, a separate control line to said valve in said second channel and a time-controlled mechanism for opening said valve.

4. The combination as set forth in claim 1 wherein said plug is a disappearing plug.

5. The combination as set forth in claim 1 wherein said plug is made from at least one of glass, ceramic materials, hard-pressed salt, and a material dissolvable in liquid.

6. In combination, a pipe;

a plug of a removable material seated in said pipe to seal an upper volume of said pipe from a lower volume of said pipe;

at least one bypass channel in said pipe communicating said upper volume of said pipe with said lower volume of said pipe, said bypass channel including an axially disposed chamber, an upper boring communicating said upper volume of said pipe with said axially disposed chamber and a lower boring communicating said lower volume of said pipe with said axially disposed chamber; and a closing body disposed in said axially disposed chamber for axial movement between a first position maintaining said upper volume of said pipe and said lower volume of said pipe in fluid communication with each other and a second position closing communication between said upper volume of said pipe and said lower volume of said pipe.

7. The combination as set forth in claim 6 wherein said closure body is disposed above said lower boring in said second position whereby said plug and said closure body constitute a complete closure of said upper volume of said pipe and said lower volume of said pipe from each other.

8. In combination, a pipe;

a plug of a removable material seated in said pipe to seal an upper volume of said pipe from a lower volume of said pipe;

at least one bypass channel in said pipe communicating said upper volume of said pipe with said lower volume of said pipe, said bypass channel being ring-formed about a circumference of said pipe and including an axially disposed chamber and a plurality of borings communicating said upper volume of said pipe with said axially disposed chamber and said lower volume of said pipe with said axially disposed chamber; and a closing body disposed in said axially disposed chamber for axial movement between a first position maintaining said upper volume of said pipe and said lower volume of said pipe in fluid communication with each other and a second position closing communication between said upper volume of said pipe and said lower volume of said pipe.

* * * * *